US005992167A

United States Patent [19]

Hill et al.

[11] Patent Number: 5,992,167

[45] Date of Patent: Nov. 30, 1999

[54] ICE MAKER

[75] Inventors: Gerald E. Hill, Fenton; Bruce Van Vlack, Goodrich; Dennis Dent, Fenton; Nickolas Misekow, Clio; Daniel McDermott, Grand Blanc; Richard Stout, Northville; Henry Brown, White Lake Township, all of Mich.

[73] Assignee: Varity Automotive Inc., Buffalo, N.Y.

[21] Appl. No.: 09/057,092

[22] Filed: Apr. 7, 1998

[51] Int. Cl.[6] ..... F25C 1/12

[52] U.S. Cl. ..... 62/188; 62/347

[58] Field of Search ..... 62/71, 73, 347, 62/351, 353, 188; 137/392

[56] References Cited

U.S. PATENT DOCUMENTS

| | | | |
|---|---|---|---|
| 2,770,102 | 11/1956 | Roedter | 62/353 |
| 2,941,377 | 6/1960 | Nelson | 62/353 |
| 2,949,749 | 8/1960 | Reddi | 62/353 |
| 3,206,940 | 9/1965 | Archer | 62/353 |
| 3,393,531 | 7/1968 | Parr | 62/356 |
| 3,407,840 | 10/1968 | Finnegan | 137/392 |
| 3,678,701 | 7/1972 | Powell et al. | 62/353 |
| 3,959,981 | 6/1976 | Anderson | 62/356 |
| 4,649,718 | 3/1987 | Linstromberg et al. | 62/347 |
| 4,697,432 | 10/1987 | Cole | 62/353 |
| 4,706,465 | 11/1987 | Searl | 62/353 |
| 5,212,955 | 5/1993 | Hogan | 62/353 |
| 5,329,786 | 7/1994 | Willis et al. | 62/353 |

*Primary Examiner*—William E. Tapolcai
*Attorney, Agent, or Firm*—Wells, St. John, Roberts, Gregory & Matkin, P.S.

[57] ABSTRACT

An ice maker has an ice tray with a plurality of ice forming cavities arranged in longitudinal succession therealong, and a water distributor extending along the tray and arranged to receive water from a water feed system. The distributor serves to distribute water evenly into the cavities without the overflow of water from one to another, thereby avoiding the formation of interconnecting webs between ice masses formed in the cavities. A level detector is provided, typically in the form of a thermistor, to detect a predetermined level of water in the tray and provide a control signal when said level is detected.

15 Claims, 3 Drawing Sheets

ICE MAKER

BACKGROUND OF THE INVENTION

This invention relates to an ice maker, primarily for use in a refrigerator or freezer, and having an ice tray with a plurality of water receptor cavities, in each of which an ice mass is formed, in use, and a water feed system operable to feed water to the tray for filling the cavities.

DESCRIPTION OF THE PRIOR ART

In one conventional proposal, the tray cavities are filled one at a time and water from each filled cavity overflows into the next until all the cavities are filled. A disadvantage of this proposal is that the formed ice masses are often interconnected by a web of ice extending between adjacent cavities, which can hinder the operation of an automatic ice ejector system of the ice maker. It can also be difficult to produce ice masses of regular shape using the aforesaid proposal.

SUMMARY OF THE INVENTION

An object of the invention is to provide an ice maker in which the aforesaid disadvantages are alleviated or avoided.

According to one aspect of the invention, an ice maker comprises an ice tray having a plurality of ice forming cavities arranged in longitudinal succession therealong, and a water distributor extending along the tray and arranged to receive water from a water feed system, the water distributor serving to distribute water evenly into said cavities.

The provision of the distributor enables the cavities to be filled without the overflow of water from one to another, thereby reducing or avoiding the formation of interconnecting webs between the formed ice masses.

Preferably, the distributor extends along a portion of the tray, which may conveniently be an edge portion, adjacent the cavities.

In one convenient arrangement, the distributor provides a channel which is floodable with water such that the water overflows into the cavities. Typically, the tray is movable between first and second positions, in the latter of which the distributor temporarily provides the floodable channel, the tray being conveniently arranged so that, when moved from the second to the first position, water collected in the distributor is evenly distributed into the cavities by emptying of the distributor.

Preferably, a level detector means is provided and operable to detect a predetermined level of water in the tray when in its second position, actuating means being arranged and operable, in response to a signal from the detector means, to actuate drive means to move the tray from the second position to the first position.

From another aspect of the invention, an ice maker comprises an ice tray having at least one ice forming cavity, a water feed system operable to feed water to the tray, and level detector means operable to detect a predetermined level of water in the tray.

Typically, the tray has a plurality of cavities arranged in longitudinal succession therealong, and a water distributor extending along the tray and arranged to receive water from the water feed system, the water distributor serving to distribute the water evenly into said cavities, the tray being movable between first and second positions, in the latter of which the distributor provides a floodable channel, the detector means being arranged to detect a predetermined level of water in the tray when in its said second position and to provide a signal in response to which drive means moves the tray from the second to the first position. Flow control means is conveniently also operable in response to said signal to stop the flow of water from the water feed system to the tray.

The provision of the level detector enables the ice maker to be controlled by a microprocessor to provide automatic operation in a continuous manner.

Other and further objects of the present invention will become evident from an understanding of the following illustrative embodiment, or will be indicated in the appended claims.

DESCRIPTION OF THE PREFERRED EMBODIMENT

An embodiment of the present invention will now be described, with reference to the accompanying drawings.

Figure 1:
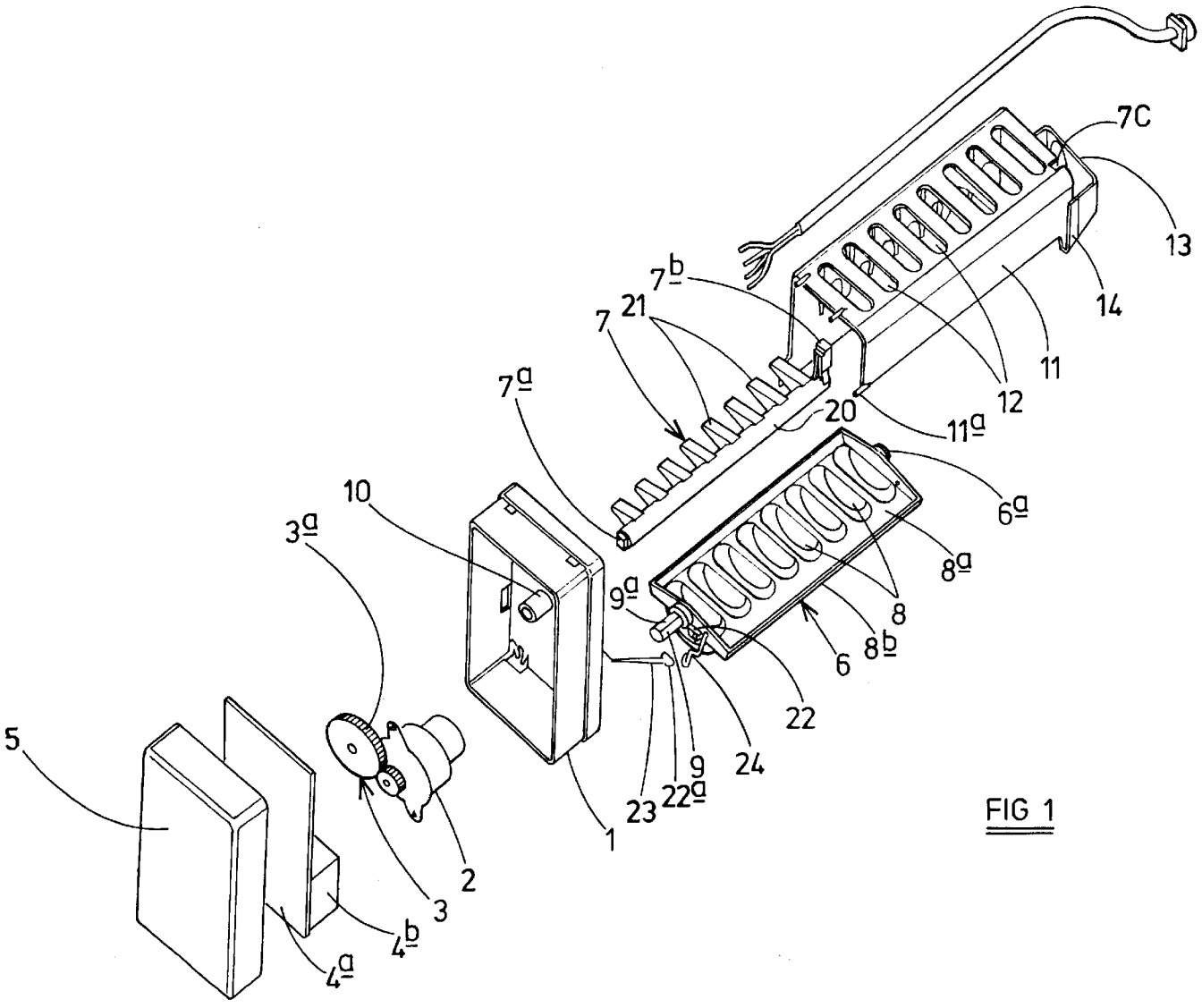
FIG. 1 an exploded perspective view of one form of the ice maker of the invention.

Referring first to FIG. 1, an ice maker, intended for installation in the freezer area of a refrigerator or freezer, has a hollow casing 1 which houses a drive motor 2 from which an output drive is taken through a gear mechanism 3. An electronic unit, which includes a circuit board 4*a* and a transformer 4*b* is housed within the casing 1 and the casing is closed by a covering lid 5.

The casing 1 serves as a main support structure of the ice maker and carries an ice tray 6 and an ice mass ejector assembly 7 which lies above and extends longitudinally of the tray. The tray has a plurality of ice forming cavities or compartments 8 of which eight are provided in the illustrated embodiment. A projecting drive shaft 9 of the tray is of non-circular cross-section, illustrated with a flat 9*a*, and extends through an internal boss 10 of the casing 1 and into driving engagement with an output gear 3*a* of the gear mechanism 3. By this means, the tray can be driven in rotation through a limited arc, as will be described hereafter. A cover 11 is provided, having a generally inverted channel shape, and is attached to the casing 1 by a suitable means illustrated as snap-engaging tags 11*a* on the cover which cooperate with complementary recesses (not shown) on the casing. The cover extends entirely over the cavities 8 and is provided in its upper wall with a series of apertures, shown as slots 12, which respectively correspond with and overlie the cavities 8. The end wall of the cover remote from the casing provides rotational support for the adjacent end of the tray 8 in the form, for example, of a hollow boss which houses a corresponding solid boss 6*a* of the tray.

The end of the cover remote from the casing 1 carries part of a water feed system, namely a formation which may conveniently be moulded integrally with the cover, forming a fluid collector 13 extending over a major part of the end of the cover and terminating in an outlet spout 14 which extends along the adjacent side of the cover in a direction towards the casing 1. The aforesaid adjacent side of the cover lies inwardly of the adjacent free edge of the tray 6 so that the spout may direct fluid onto a surface 8*a* of the tray, which bridges across all of the cavities 8 and acts as a fluid distributor serving to direct water into all of the cavities. The outermost lateral edge of the surface 8*a* is delimited by a part 8*b* of an upstanding peripheral wall of the tray.

Figure 2:
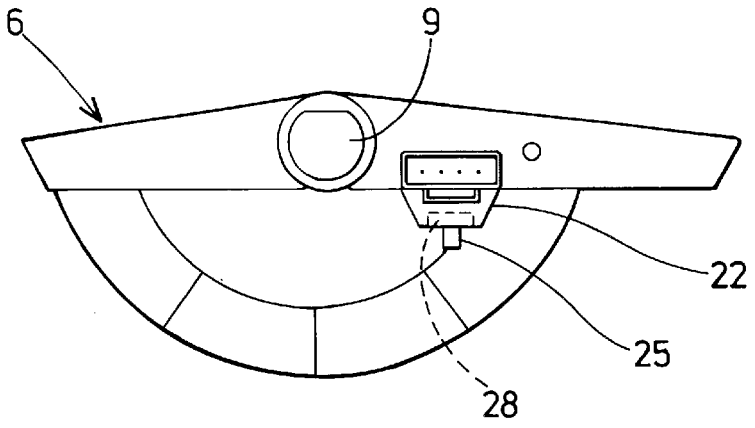
FIG. 2 is an end view of part of the ice maker of FIG. 1 illustrated in a first position.
Figure 3:
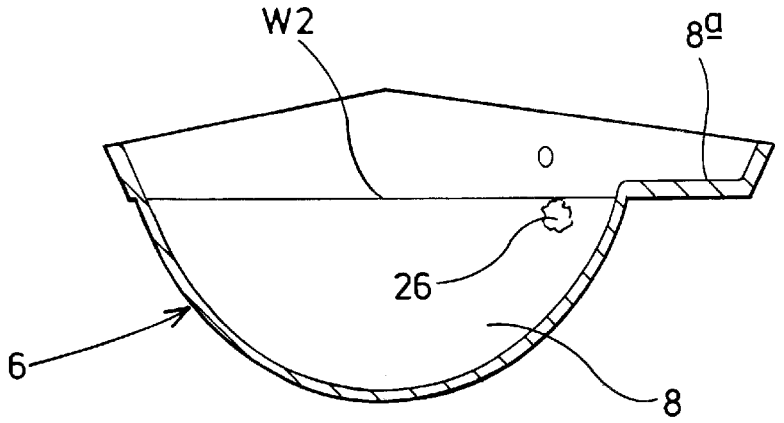
FIG. 3 cross-section of the aforesaid part of FIG. 2 in said first position.
Figure 4:
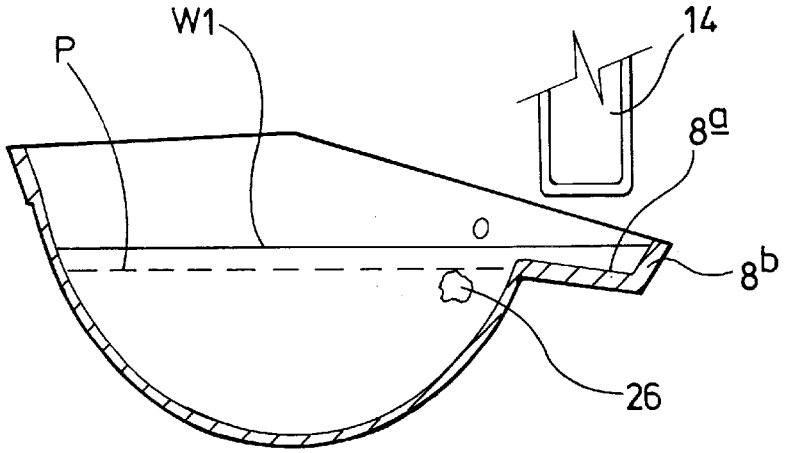
FIG. 4 is a view similar to FIG. 3 with said part in an alternative position.

The ejector assembly 7 has a stem 20 which extends above and longitudinally of the tray and is mounted non-rotatably in a recess (not shown) of the casing by way of a generally square end boss 7*a* and in a cut-out 7C at the remote end of the cover by way of a support formation 7*b* of the stem. The stem carries a plurality of ejector members, shown as fingers 21, conveniently formed integrally therewith by moulding and corresponding in numbers to the cavities 8, which they respectively overlie. The lengths of the fingers 21 are illustrated as increasing progressively from the casing end of the assembly towards its other end, although they may alternatively be of equal lengths and/or staggered around the longitudinal axis of the stem 20. A thermistor 26 is embedded in the tray, as shown in FIGS. 3 and 4, and is electrically accessible by means of a connector 22 (FIG. 2) for receiving a plug 22*a* carried by a wiring harness, part of which can be seen at 23 and which is connected to the transformer 4*b* and circuit board 4*a*. The tray carries the connector 22, as well as a bale arm 24 (FIG. 1) which extends along the underside of the tray and is pivotally mounted on the side walls of the tray for cooperation with a button 25 of a switch 28 carried by the connector 22, in the manner to be described.

Figure 5:
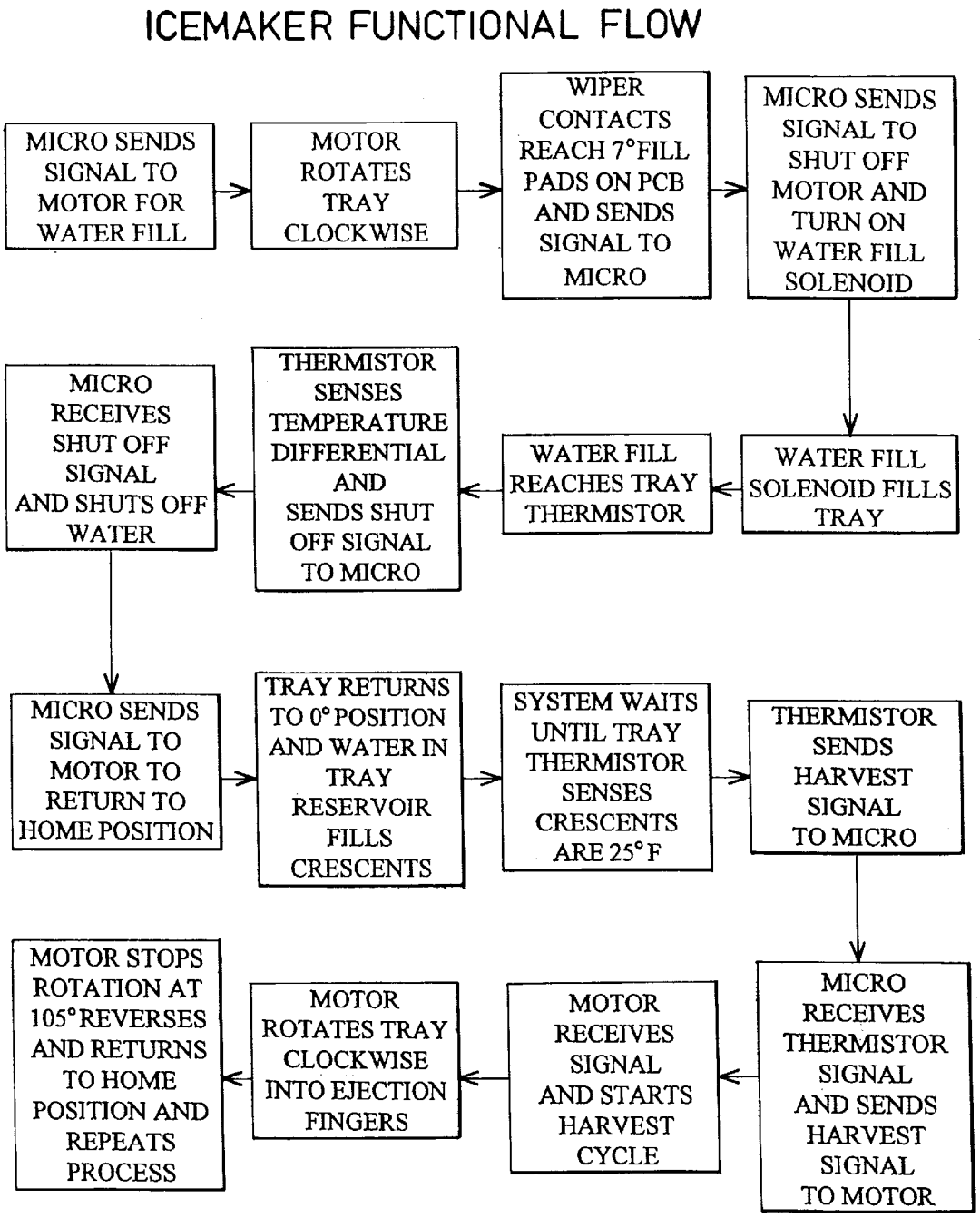
FIG. 5 is a functional flow diagram illustrating an operational cycle of the ice maker of the invention.

An operational cycle of the ice maker of the invention will now be described. As can be seen from the flow diagram of FIG. 5, the microprocessor 4*a* provides a signal to the motor 2 which, via the gear mechanism 3, rotates the tray 6 clockwise through a small angle, typically about 7°, to the position shown in FIG. 4. When the tray reaches this position, wiper electrical contacts (not shown) associated with the tray complete a circuit, causing the microprocessor to provide a signal to a solenoid controlling the supply of water to the collector 13 and thence via the spout 14 into the distributor channel formed by the surface 8*a* and adjacent upstanding wall part 8*b* when the tray is in the tilted position of FIG. 4. Water flows from this channel into the adjacent ends of the cavities 8 which are all filled to the same predetermined level P. At this time, the thermistor 26 will have sensed the temperature difference between the relatively warm incoming water and the surrounding freezer environment and will cause a signal to be sent to the microprocessor which, in turn, sends a water shut-off signal to the solenoid to interrupt the supply of water to the tray. The water remaining in the water feed system 13, 14 runs into the distributor and raises the level of water in the tray to a desired level W1. The microprocessor also sends a signal to the motor 2 to return the tray from the FIG. 4 position to the level position of FIG. 3, allowing the accumulated water in the distributor channel to flow into the cavities 8, resulting in a new water level W2 in each of the cavities which will be substantially the same in each cavity and below the level of the surface 8*a*. It will be seen that, when the distributor channel has been emptied, there is substantially no water bridging between the cavities which could result in the formation of ice webs in the frozen ice masses.

The system now awaits the freezing of the water accumulated in the cavities 8 and this is again sensed by the thermistor 26 which provides a corresponding signal to the microprocessor to initiate operation of the ice ejection process. To this end, the microprocessor provides a signal to the motor 2 to rotate the tray in a clockwise direction to bring the ice ejection fingers 21 into contact with the ice masses. Because the ejector fingers are of progressively differing lengths in this embodiment, the ice masses will be contacted in succession by the fingers, starting with the longest finger, so that the masses are ejected singly in succession. The tray is rotated through approximately 105°, enabling the masses to fall to a location directly below the tray, following which the tray is rotated in reverse to its fill position illustrated in FIG. 4 to enable the ice making cycle to be repeated automatically. Should the ice collecting location become full, this is sensed by the bale 25 coming into contact with the accumulated ice and swinging in an clockwise direction relative to the tray and into contact with the button 25 of the switch 28 on the connector 22. Operation of the switch 28 switches off the ice maker and maintains it in this condition until the accumulated ice has been removed, whereupon the bale 25 swings back, releasing the switch button 25, thereby permitting ice making to be recommenced.

Not only does the aforementioned process provide substantially uniform ice masses, with little or no connecting webs between them, but operating the water supply to the tray via the collector 13 and spout 14 and sensing the actual water level in the tray, enables the process to be carried out substantially independently of the water supply pressure, which again, contributes to the achieved uniformity of the ice masses.

The ice maker has a simplified structure as compared to known electro-mechanically operated ice makers, facilitating more efficient manufacture, greater reliability and smaller dimensions.

We claim:

1. An ice maker comprising an ice tray having a plurality of separate ice forming cavities arranged in longitudinal succession therein, and a water distributor extending continuously along the tray and arranged to receive water from a water feed system, the water distributor providing a channel which is floodable with water such that the water overflows into said cavities and serving to distribute water evenly therefrom into each of said cavities.

2. An ice maker as claimed in claim 1, wherein the distributor extends along a portion of the tray adjacent the cavities.

3. An ice maker as claimed in claim 1, and further comprising a level detector operable to detect a predetermined level of water in the tray, wherein the level detector comprises a thermistor.

4. An ice maker as claimed in claim 1, wherein, in operation, water is distributed from above the cavities, downwardly into each said cavity.

5. An ice maker comprising an ice tray having a plurality of ice forming cavities arranged in longitudinal succession therein; a water distributor extending along the tray and arranged to receive water from a water feed system, the water distributor serving to distribute water evenly into said cavities, the water distributor extending along a portion of the tray adjacent the cavities, and the water distributor providing a channel which is floodable with water such that the water overflows into said cavities; and drive means operable to move the tray between first and second positions, in the latter of which the distributor temporarily provides said floodable channel.

6. An ice maker as claimed in claim 5, wherein the tray is arranged so that when it is moved from its second position to its first position water collected in the distributor is evenly distributed into the cavities by emptying of the distributor.

7. An ice maker as claimed in claim 6, wherein the tray is tiltably movable between the first and second positions.

8. An ice maker as claimed in claim 7, wherein level detector means is arranged to detect a predetermined level of water in the tray when in its second position; actuating means being provided and operable, in response to a signal from the detector means, to actuate said drive means to move the tray from the second position to the first position.

9. An ice maker as claimed in claim 8, wherein the distributor comprises an upwardly extending tray wall and a tray surface extending between the base of the wall and the cavities.

10. An ice maker as claimed in claim 8, further comprising flow control means arranged to receive a signal from the level detector means and operable to stop the flow of water from said water feed system to the tray in response to said signal to obtain a desired level of water in the tray when in its second position.

11. An ice maker as claimed in claim 10, wherein said desired level of water in the tray lies above locations on the tray where said tray surface and said cavities meet.

12. An ice maker as claimed in claim 10, wherein said desired level is selected to correspond to a predetermined quantity of water sufficient to fill each said cavity only partially when evenly distributed into the cavities.

13. An ice maker as claimed in claim 8, wherein the level detector means comprises a temperature sensitive device.

14. An ice maker as claimed in claim 13, controlled by a microprocessor.

15. An ice maker comprising:

an ice tray having a plurality of ice forming cavities arranged in longitudinal succession therein;

a water distributor extending along the tray and arranged to receive water from a water feed system, the water distributor serving to distribute water evenly into said cavities, the water distributor extending along a portion of the tray adjacent the cavities, and the water distributor providing a channel which is floodable with water such that the water overflows into said cavities; and a drive mechanism operable to move the tray between first and second positions, in the latter of which the distributor temporarily provides said floodable channel.

* * * * *